US007884138B2

(12) United States Patent
Mayer et al.

(10) Patent No.: US 7,884,138 B2
(45) Date of Patent: Feb. 8, 2011

(54) PROCESS FOR MAKING FISCHER-TROPSCH OLEFINIC NAPHTHA AND HYDROGENATED DISTILLATES

(75) Inventors: Jerome F. Mayer, Lincoln, CA (US); Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 374 days.

(21) Appl. No.: 11/956,455

(22) Filed: Dec. 14, 2007

(65) Prior Publication Data

US 2008/0319094 A1 Dec. 25, 2008

Related U.S. Application Data

(60) Provisional application No. 60/870,074, filed on Dec. 14, 2006.

(51) Int. Cl.
*C07C 27/00* (2006.01)
*C10B 57/02* (2006.01)

(52) U.S. Cl. ..... 518/700; 702/715; 208/49

(58) Field of Classification Search ..... 518/700, 518/702, 715; 208/49
See application file for complete search history.

(56) References Cited

U.S. PATENT DOCUMENTS

| | | | |
|---|---|---|---|
| 3,862,899 | A | 1/1975 | Murphy et al. |
| 6,846,402 | B2 | 1/2005 | Hemighaus et al. |
| 6,933,323 | B2 | 8/2005 | O'Rear et al. |
| 6,974,844 | B2 | 12/2005 | Steynberg et al. |
| 7,179,364 | B2 | 2/2007 | O'Rear et al. |
| 2004/0148850 | A1 | 8/2004 | O'Rear et al. |
| 2004/0149626 | A1 | 8/2004 | O'Rear et al. |
| 2004/0152930 | A1 | 8/2004 | O'Rear et al. |
| 2005/0145540 | A1 | 7/2005 | O'Rear |
| 2007/0187291 | A1 | 8/2007 | Miller et al. |
| 2007/0187292 | A1 | 8/2007 | Miller et al. |

*Primary Examiner*—Jafar Parsa
(74) *Attorney, Agent, or Firm*—A. Stephen Zavell

(57) ABSTRACT

A process is described by which an olefinic naphtha and a hydrogenated distillate fuel are made from a Fischer-Tropsch process. The olefinic naphtha is suitable for use in an ethylene cracker where the olefins enhance the formation of ethylene. Thy hydrogenated distillate fuel is used in jet and or diesel fuels. Optionally the olefinic naphtha has a low content of acids. This low acid content, is obtained by operating the Fischer-Tropsch unit at $H_2$/CO ratios from 1.8 to 2.05 or treating the effluent from the Fischer-Tropsch unit with a metal oxide to remove the acids.

13 Claims, 3 Drawing Sheets

PROCESS FOR MAKING FISCHER-TROPSCH OLEFINIC NAPHTHA AND HYDROGENATED DISTILLATES

BACKGROUND OF THE INVENTION

Fischer-Tropsch products after hydrotreating and hydrocracking under typical conditions are generally devoid of olefins, alcohols, acids and other oxygenates. By themselves they are highly stable and when appropriate precautions are used they make excellent blend components for distillate fuels when used with petroleum-derived distillate fuels. When the oxygenates are left in the diesel fuel they can contribute to peroxide formation. This problem can be solved by the use of anti-oxidants as described in U.S. Patent Application Publication Nos. 20040152930 and 20040148850.

The naphtha product from a Fischer-Tropsch product consists of paraffins, olefins and oxygenates (alcohols, acids, and traces of other compounds). All compounds are predominantly linear (normal paraffins, linear olefins, linear alcohols etc.). The linear paraffins and especially the linear olefins are desirable for making ethylene in naphtha crackers. The alcohols and especially the acids are not desirable because the latter contributes to corrosion.

Technology to remove the alcohols and acids from Fisher-Tropsch condensates to make olefinic naphtha for ethylene production has been developed and is described in U.S. patent application Ser. Nos. 10/355,279 and 10/354,956.

However in some situations customers for distillate fuels would prefer not to have fuels that contain olefins. Thus it can be desirable to make a olefinic naphtha while simultaneously making a hydrogenated distillate fuel. This application addresses this combined need.

DEFINITIONS

Hydrogenated distillate fuel is a distillate fuel in which all the components have at one time or another been hydrogenated at pressures greater than atmospheric preferably from 250 to 3000 psig. A reactor flow linear space velocity (LHSV) from 0.5 to 5. Reaction temperatures from 450 to 800° F. These parameters alone in combination are used over a catalyst comprising a Group VIII metal optionally with a Group VI metal. Preferred catalysts are sulfided NiMo/silica-alumina, sulfided NiW/silica-alumina, and Pt/alumina. The hydrogenated distillate fuel does not need to have all the olefins and oxygenates removed, but it should form less than 5 ppm peroxides after storage at 60° C. for 4 weeks as described in U.S. patent application Ser. Nos. 10/464,546 and 10/464,635. Preferably the hydrogenated distillate fuel contains no detectable oxygenates as described in Fuel A of U.S. Patent Application Publication No. 20040152930.

Fischer-Tropsch derived means a product that was at some point in its processing derived from a Fischer-Tropsch process. The feedstock to the Fischer-Tropsch process is synthesis gas (a mixture comprising CO, $H_2$ and optionally other gases such as $CO_2$, water, and traces of others). The synthesis gas can be formed from a variety of hydrocarbonaceous feedstocks: methane (or natural gas), coal, petroleum, and petroleum by-products such as residual oils and coke, tar sands, municipal wastes, agricultural wastes. The feedstocks can be converted to synthesis gas in above ground facilities, or can be converted underground, especially petroleum, tar sands, and coal which can be gasified underground. The preferred Fischer-Tropsch process is a Low Temperature Fischer-Tropsch (LTFT) process which is carried out at temperature generally below 250° C. as described in U.S. Pat. No. 6,846,402 and incorporated herein by reference. The most preferred Fischer-Tropsch process is a Low Temperature Fischer-Tropsch process operated in a slurry bed mode. The very most preferred process further includes uses a cobalt catalyst. Cobalt catalyst give lower levels of product oxygenate than do iron catalysts and for this reason are preferred.

Petroleum derived means a product that is derived from petroleum, but which has not been converted to synthesis gas and processed in a Fischer-Tropsch process.

SUMMARY OF THE INVENTION

We have discovered processes to simultaneously manufacture olefinic naphthas and hydrogenated distillates.

DETAILED DESCRIPTION OF THE INVENTION

Figure 1:
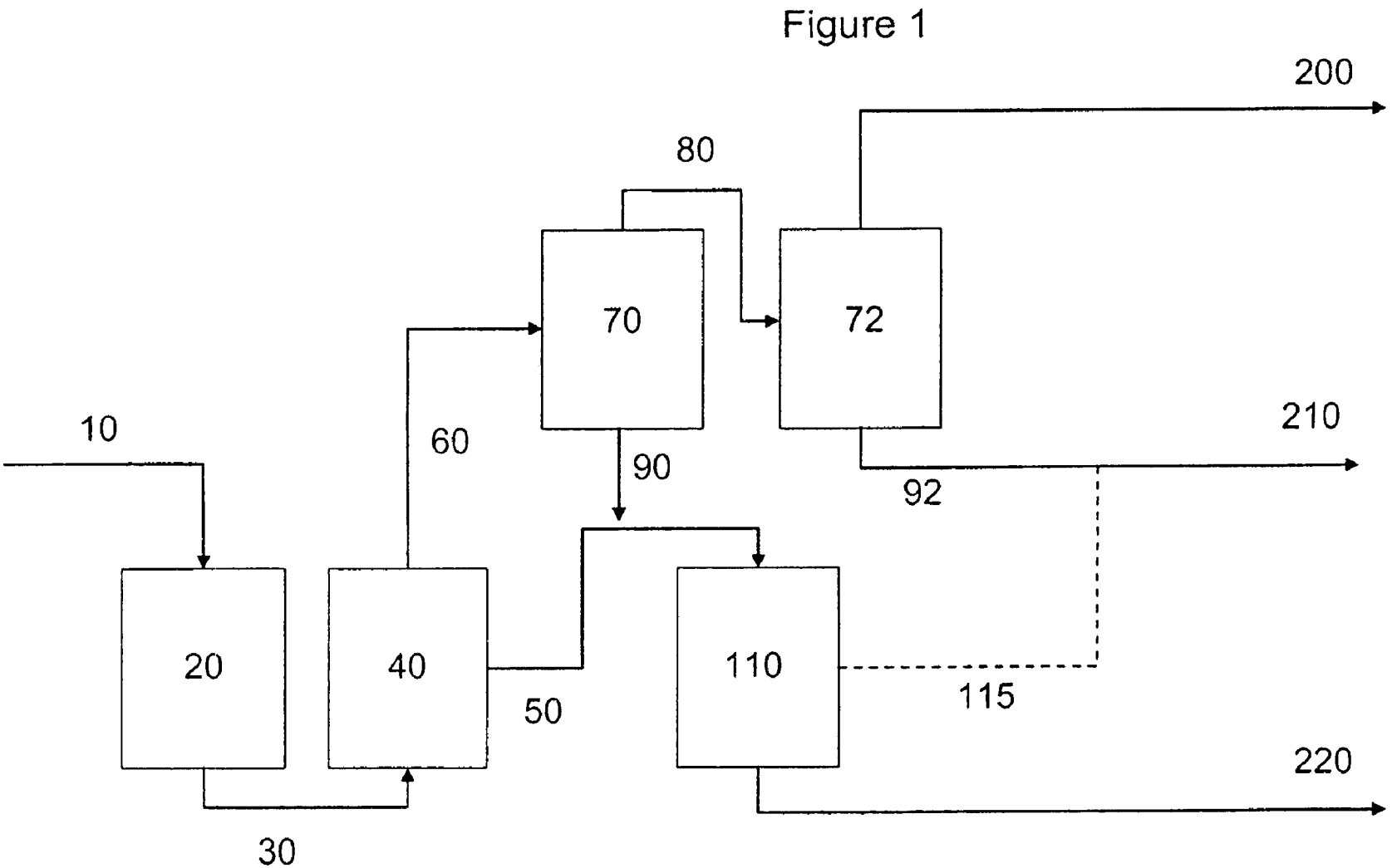
FIG. 1 illustrates an LTFT process operated to obtain an olefinic naphtha and a hydrogenated distillate.

The process generates two products streams—an overhead vapor stream, and a waxy liquid. In a preferred embodiment, the overhead vapor stream is cooled in at least two condensers. The first condenser yields a first condensate that contains material boiling in the distillate range (300° F. and heavier). The amount of material boiling above 300° F. in the first condensate is greater than or equal to 50 wt. %, preferably greater than or equal to 75 wt. %, and most preferably greater than or equal to 90 wt. %. This condensate is hydroprocessed to yield a hydrogenated distillate fuel. Optionally the wax is also hydroprocessed, preferably mixed with the first condensate. The non-condensed product from the first condenser is cooled and separated in a second condenser to yield a second condensate. This second condensate contains lower amounts of 300° F. distillate range material. The amount of material boiling above 300° F. in the second condensate is less than or equal to 90 wt. %, preferably less than or equal to 75 wt. %, more preferably less than or equal to 50 wt. %, and most preferably less than or equal to 25 wt. %.

Since naphtha crackers can operate on 300° F.– and 300° F.+ materials, the content of 300° F.+ material in the naphtha is not critical. Optionally the separation efficiency of the condensers can be improved by inclusion of some fractionation equipment such as trays, packing, overhead condensate reflux and other items known in the art. The second condensate contains olefins and is used to make the olefinic naphtha. The second condensate can be blended with other materials, such as naphthas derived from hydroprocessing the first condensate and/or the wax. The second condensate can also be blended with condensated recovered from gas field operations. The olefin content of the second condensate should be greater than 10 wt % and preferably between 10 and 80 wt. %. Most preferably the properties of the second condensate comprise olefins in an amount of 10 to 80 weight %; non-olefins in an amount of 20 to 90 weight %, wherein the non-olefins comprise greater than 50 weight % paraffins; sulfur in an amount of less than 10 ppm by weight; nitrogen in an amount of less than 10 ppm by weight; aromatics in an amount less than 10 weight %; a total acid number of less 1.5, and a boiling range of $C_5$ to 400° F., as amplified in U.S. Publication No. 2004/0149626 incorporated herein by reference.

Fischer-Tropsch products can contain acids. In some situations these can be beneficial, such as reduction in corrosion during transport or improving lubricity, the acids are undesirable if they are present in excessive amounts. The acid number of the olefinic naphtha should be less than 1.5 mg KOH/gram as measured by ASTM D 664 as described in U.S. Publication No. 2004/0149626. Preferably the acid number should be less than 0.5 mg KOH/gram and most preferably less than 0.1 mg KOH/gram. The acid content of the olefinic naphtha, with a metal oxide at elevated temperatures. Alternatively, the acid content of the olefinic naphtha can be reduced by adjusting the conditions on the Fischer-Tropsch unit—by use of cobalt rather than iron catalysts, or by operating at reactor inlet $H_2$/CO molar ratios between 1.65 and 2.0 preferably between 1.75 and 1.95, and most preferably between 1.80 and 1.90.

DESCRIPTION OF PREFERRED EMBODIMENTS

FIG. 1 illustrates an embodiment which simultaneously produces an olefinic naphtha and hydrogenated distillate. This operation describes methane as a feedstock for the process, but others feedstocks such as coal, biomass, etc., could be used without diverging from the invention. Methane (10) is converted to synthesis gas (30) in a synthesis gas forming reactor (20). The synthesis gas (30) is reacted in a Fischer-Tropsch unit (40) to form a vapor product (60) and a waxy liquid product (50). The waxy liquid product is hydrocracked in a hydocrack (110) to form a hydrogenated distillate (220). The vapor product from the Fischer-Tropsch reactor is cooled by exchangers (not shown) and put into a first condenser (70) to form a first condensate (90) and a first uncondensed gas (80). The first condensate is mixed with the waxy liquid and fed to the hydrocracker (110). The first uncondensed gas is further cooled by exchangers (not shown) and put into a second condenser (72) to form a second condensate (92) which is at least a part of the olefinic naphtha product (210). A second uncondensed gas (200) is produced. This is either uncondensed gas (20) used as fuel, recycled to the Fischer-Tropsch reactor, recycled to: the synthesis gas forming reactor, or combinations of these uses. Optionally the hydrocracker will make a naphtha product (115) which is blended with the second condensate (92) to form the olefinic naphtha product (210). Optionally the Fischer-Tropsch unit is operated so that the olefinic naphtha has an acid number of less than 0.5 mg KOH/g by use of a cobalt catalyst and a synthesis gas ratio of 1.75 to 1.95.

Figure 2:
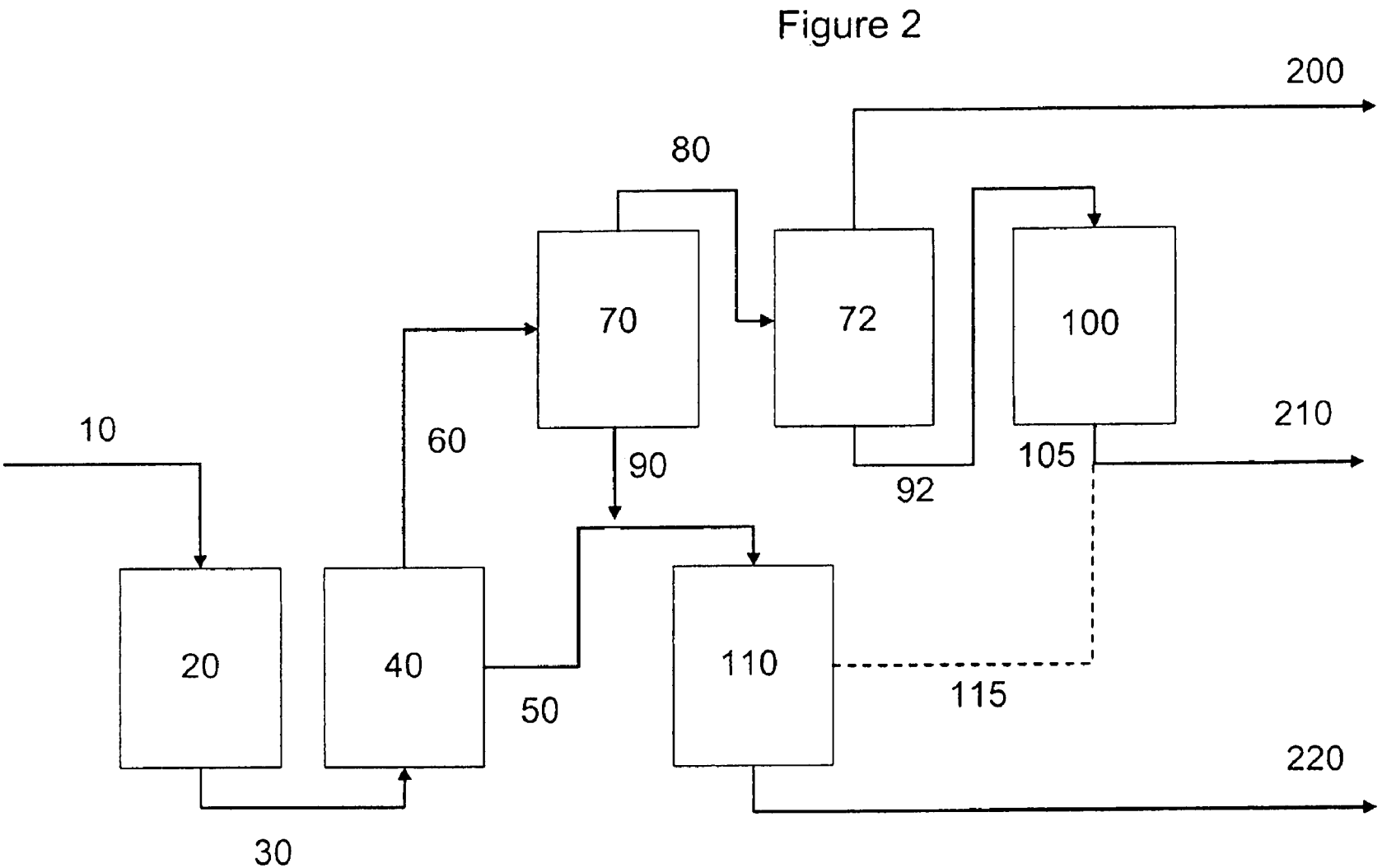
FIG. 2 is an alternative embodiment of the invention.

FIG. 2 shows another embodiment which produces an olefinic naphtha and hydrogenated distillate and which includes a treatment step on the second condensate to remove oxygenates from the naphtha. Elements from FIG. 1 were carried over to the embodiment of FIG. 2. In this embodiment, the second condensate is passed downflow through a purification unit (100) at 680° F., 50 psig, and 5 LHSV without added gaseous components. The purification unit contains alumina. The purification unit removes more than 80% of the oxygenated compounds, increases the olefin content, and reduces the acidity of the olefinic naphtha (105). At least a portion of the treated olefinic naphtha is used in the marketed olefinic naphtha (210). Optionally the naphtha product from the hydrocracker is included in the marketed olefinic naphtha.

Figure 3:
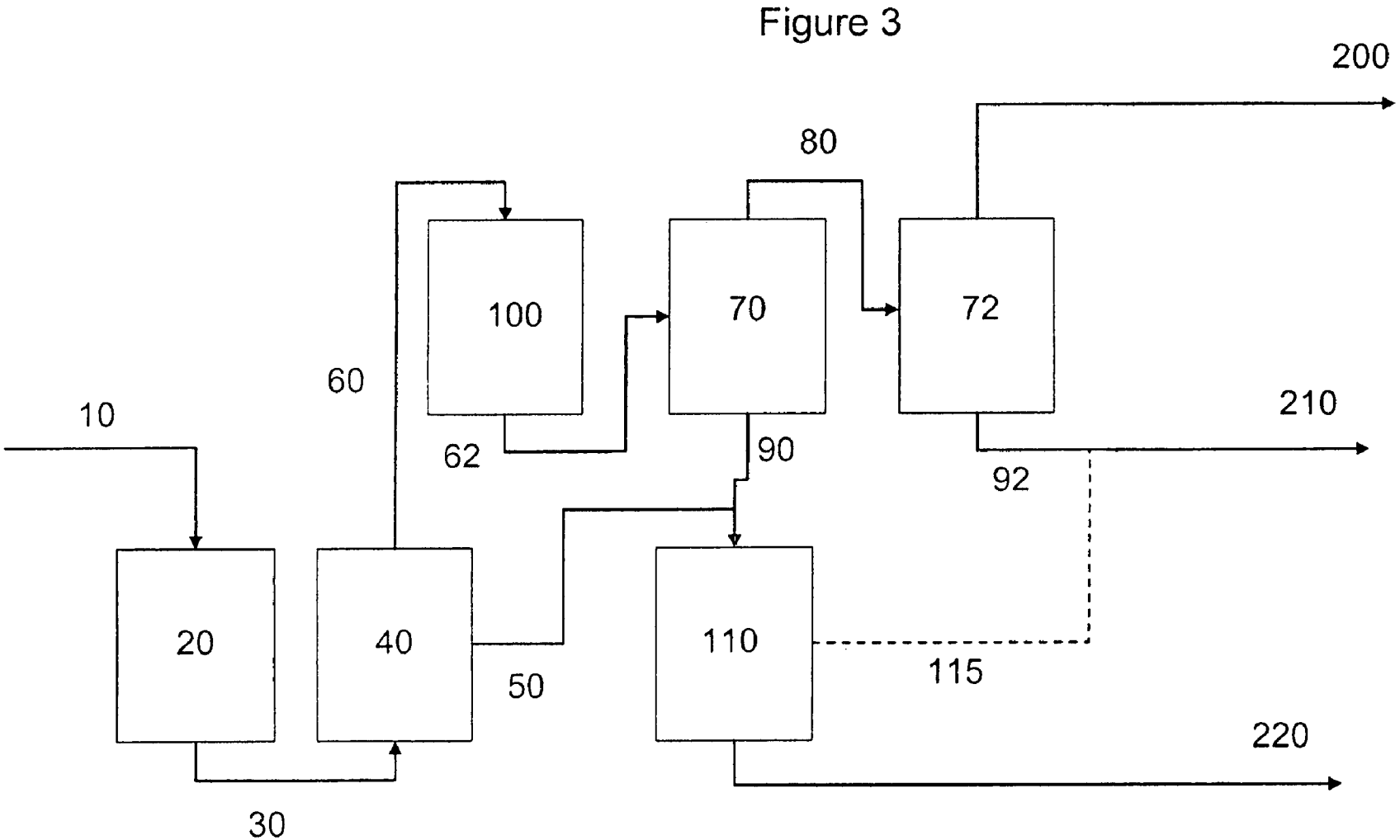
FIG. 3 is a further alternative embodiment of the invention.

FIG. 3 shows a further embodiment which produces an olefinic naphtha and hydrogenated distillate and which includes a treatment step on the Fischer-Tropsch vapor product to remove oxygenates from the naphtha. Elements from FIG. 1 and FIG. 2 were carried over to the embodiment of FIG. 3. In this embodiment, the vapor phase product (60) form the Fischer-Tropsch reactor is passed downflow through a purification unit (100) at 680° F., 50 psig, and 1 LHSV without added gaseous components. The LHSV is defined on the basis of the $C_{4+}$ products in the Fischer-Tropsch vapor product. This embodiment has the advantage of removing acids ahead of the condensers thus reducing the potential corrosion problems in these units. The treated vapor product (62) is cooled and sent to the first separator (70) to make a first condensate (90) and first uncondensed gas (80).

Water formed in the Fischer-Tropsch reactor (and formed by the purification unit in FIG. 3) is separated as a third phase in the first condenser, second condenser or both. The separated water stream is not shown for simplicity.

Optionally the first and/or second condenser contains equipment to improve the separation efficiency such as trays, packing, overhead condensate reflux and other items known in the art. Most preferably the first condenser contains this equipment.

What is claimed is:

1. A process of producing an olefinic naphta, a hydrogenated distillate, and a gas field condensate blend comprising:

a. converting at least a portion of a hydrocarbon asset to synthesis gas;

b. converting at least a portion of the synthesis as to a vapor product and a waxyy liquid product in a Fischer-Tropsch process unit;

c. cooling the vapor product and separating first condensate and a first uncondensed gas in a first condenser;

d. cooling the first uncondensed gas and separating a second condensate and second uncondensed gas in a second condenser;

e. producing an olephinic naphtha from at least portion of the second condensate;

f. producing a hydrogenated distillate from a feedstock selected from the group consisting of the first condensate, the waxy liquid product, and combinations; and g. blending the second condensate with a condensate recovered from gas field operations.

2. The process of claim 1 wherein the Fisher-Tropsch process uses a cobalt catalyst.

3. The process of claim 1 wherein the synthesis gas fed to the Fischer-Tropsch reactor has a $H_2$/CO molar ratio greater than or equal to 1.65 and less than or equal to 2.0.

4. A process of claim 3 wherein the ratio is greater than or equal to 1.75 and less than or equal to 1.95.

5. A process of Claim 4 wherein the ratio is greater than or equal to 1.80 and less than or equal to 1.90.

6. A process according to claim 1 further comprising treating the second condensate by contact with a metal oxide at elevated temperatures.

7. A process according to claim 6, wherein the metal oxide is selected from the group consisting of alumina, silica, silica-alumina, zeolites, clays, and mixtures thereof.

8. A process according to claim 7, further comprising the step of separating and carbon dioxide formed in the purifying step from the purified olefinic naphtha.

9. A process according to claim 8, wherein the purifying step reduces the content of solids, acids, and alcohols in the olefinic naphtha.

10. A process according to claim 1, wherein the olefinic naphtha isolated has a total acid number of less than 1.5 mg KOH/g.

11. A process according to claim 10 wherein the acid number is less than 0.5 mg KOH/g.

12. A process according to claim 11 wherein the acid number is less than 0.01 mg KOH/g.

13. A process according to claim 1 wherein hydrogenated distillates forms less than 5 ppm of peroxides after storage at 60° C. for 4 weeks.

* * * * *